US011059501B2

(12) United States Patent
Eisele

(10) Patent No.: US 11,059,501 B2
(45) Date of Patent: Jul. 13, 2021

(54) LINKAGE DEVICE FOR A VEHICLE COUPLING

(71) Applicant: Faiveley Transport Schwab AG, Schaffhausen (CH)

(72) Inventor: Thomas Eisele, Lauchringen (DE)

(73) Assignee: FAIVELEY TRANSPORT SCHWAB AG, Schaffhausen (CH)

( * ) Notice: Subject to any disclaimer, the term of this patent is extended or adjusted under 35 U.S.C. 154(b) by 452 days.

(21) Appl. No.: 16/011,735

(22) Filed: Jun. 19, 2018

(65) Prior Publication Data

US 2019/0283786 A1 Sep. 19, 2019

(30) Foreign Application Priority Data

Mar. 16, 2018 (EP) ..... 18162197

(51) Int. Cl.

| | |
|---|---|
| ***B61G 9/06*** | (2006.01) |
| ***B61G 7/08*** | (2006.01) |
| ***B61G 9/24*** | (2006.01) |
| ***B61G 7/10*** | (2006.01) |
| ***B61G 9/04*** | (2006.01) |
| ***B61G 11/16*** | (2006.01) |

(52) U.S. Cl.

CPC ..... *B61G 9/06* (2013.01); *B61G 7/08* (2013.01); *B61G 7/10* (2013.01); *B61G 9/04* (2013.01); *B61G 9/24* (2013.01); *B61G 11/16* (2013.01)

(58) Field of Classification Search

CPC ... B61G 7/08; B61G 7/10; B61G 9/06; B61G 9/24; B61G 11/16; B61G 7/14; B61G 9/04

See application file for complete search history.

(56) References Cited

U.S. PATENT DOCUMENTS

| | | | | |
|---|---|---|---|---|
| 3,906,868 A * | 9/1975 | Ksiensyk | ..... | B61G 7/10 213/64 |
| 4,064,998 A * | 12/1977 | Dilg | ..... | B61G 11/16 213/69 |
| 4,136,787 A * | 1/1979 | Forster | ..... | B61G 7/12 213/40 R |

(Continued)

FOREIGN PATENT DOCUMENTS

| | | |
|---|---|---|
| EP | 2322403 B1 | 9/2014 |
| EP | 2537730 B1 | 2/2017 |
| EP | 3205551 A1 | 8/2017 |

OTHER PUBLICATIONS

Abstract of EP3205551A1, published on Aug. 16, 2017.
Abstract of EP2537730B1, published on Feb. 15, 2017.

*Primary Examiner* — Zachary L Kuhfuss
(74) *Attorney, Agent, or Firm* — Christopher R. Carroll; The Small Patent Law Group LLC

(57) ABSTRACT

Linkage device for a couplings of railway vehicles, the coupling head of which is connected to a drawbar linked to a steering pivot of the railway vehicle, which drawbar is provided with spring elements sitting on it in order to dampen compressive and tensile force that arise, e.g., when coupling the railway vehicle. The spring elements are fastened to a plate that can be rotated about an axis of rotation of the steering pivot. In this way, they are also deflected when the coupling is deflected so that the compressive and tensile forces acting on the latter also act upon its entire surface evenly, even when the coupling is deflected. The linkage device is also provided with overload protection.

20 Claims, 2 Drawing Sheets

(56) References Cited

U.S. PATENT DOCUMENTS

| | | | | |
|---|---|---|---|---|
| 6,315,139 | B1 * | 11/2001 | Kreher | B61G 9/06 213/9 |
| 6,499,613 | B1 * | 12/2002 | Grau | B61G 7/14 213/7 |
| 7,513,376 | B2 * | 4/2009 | Sprave | B61G 7/14 213/75 R |
| 7,552,830 | B2 * | 6/2009 | Radewagen | B61G 7/14 213/9 |
| 8,051,995 | B2 * | 11/2011 | Kontetzki | B61G 11/16 213/1 A |
| 8,714,377 | B2 * | 5/2014 | Peckham | B61G 11/16 213/65 |
| 8,960,464 | B2 * | 2/2015 | Peckham | B61G 9/24 213/9 |
| 9,440,664 | B2 * | 9/2016 | Liu | B61G 9/06 |
| 9,878,728 | B2 * | 1/2018 | Stroud | B61G 7/14 |
| 10,246,108 | B2 * | 4/2019 | Nikolaus | B61G 1/40 |
| 10,266,186 | B2 * | 4/2019 | Beck | B61G 7/10 |
| 10,308,262 | B2 * | 6/2019 | Westman | B61G 11/16 |
| 10,507,850 | B2 * | 12/2019 | Kontetzki | B61G 9/06 |
| 2012/0031299 | A1 * | 2/2012 | Kontetzki | B60R 19/34 105/392.5 |
| 2012/0199545 | A1 * | 8/2012 | Peckham | B61G 9/10 213/65 |
| 2016/0318528 | A1 * | 11/2016 | Westman | B61G 1/18 |
| 2018/0154912 | A1 * | 6/2018 | Kontetzki | B61G 9/24 |
| 2018/0208007 | A1 * | 7/2018 | Eliasson | B60D 1/145 |
| 2019/0283786 | A1 * | 9/2019 | Eisele | B61G 9/06 |

* cited by examiner

LINKAGE DEVICE FOR A VEHICLE COUPLING

FIELD OF THE INVENTION

The invention relates to a linkage device for a coupling having a drawbar connectable to a coupling head, a number of spring elements mounted on the drawbar, in particular for damping the compressive and tensile forces of the railway vehicle that arise when coupling, and a flange with a housing connectable to the railway vehicle.

BACKGROUND OF THE INVENTION

A linkage device of this type is disclosed in EP 2 322 403 B1 in which the spring elements are clamped rigidly, as a result of which they cannot mimic the steering movements of the drawbar. In this way, the damping effect of the spring elements is affected because the coupling only loads them unevenly in the deflected position.

OBJECTS AND SUMMARY OF THE INVENTION

An object underlying the invention is to avoid this disadvantage and to devise a linkage device of the type specified above which ensures an optimal damping effect of the spring elements using the simplest possible means, even when the coupling is deflected. According to the invention, this object is achieved in that for a deflection, the drawbar is mounted at least in a horizontal plane in a plate that can be rotated within the housing, which plate is disposed between the spring elements.

It is thus possible for this device to enable deflection of the coupling head connected to it, and for the drawbar and the spring elements mounted thereon and this plate to likewise adopt these swiveled positions.

For the purpose of simple construction, it is particularly advantageous if the rotatable plate and the pivot pins are integrated into an annular disc with two diametrically arranged pivot pins, the annular disc being provided with a central through hole for the drawbar.

So that the spring elements can also perform deflection of the coupling in the vertical plane, the invention makes provision to form the through hole so that it widens outwardly on both sides.

Furthermore, the invention makes provision such that the spring elements are arranged on the side of the rotatable plate facing the coupling head in order to dampen the compressive forces, while the spring elements are mounted on the side of the rotatable plate facing away from the coupling head in order to dampen the tensile forces. In this way, the rotatable plate is effective in both directions of force.

The compressive forces that occur in the coupling are in practice a multiple of the tensile forces acting on it. Therefore, the invention also makes provision to determine the number of spring elements according to the respectively anticipated compressive and tensile forces.

It is advantageous for the most even possible damping effect to produce the spring elements in the form of annular discs made of an elastomeric material and which are supported laterally against spacer discs made of sheet metal lying in between.

It is also advantageous for the purpose of a simple, compact design if the spring elements are fitted on the drawbar between a bushing for the coupling head disposed on the front end of the drawbar and a locking disc disposed on the rear end of the drawbar in order to fix the spring elements against the rotatable plate.

In order to facilitate assembly, the invention also makes provision such that the locking disc can be pressed against the spring elements with a screw connection disposed on the rear end of the drawbar.

Moreover, the invention makes provision such that the steering pivot with the rotatable plate is mounted in a sleeve-shaped housing with a flange that can be fastened to the railway vehicle. In this way, the housing with the steering pivot, the rotatable plate and the drawbar with the spring elements can be fixed to the railway vehicle as a pre-assembled assembly.

The linkage device according to the invention can also be provided with overload protection. In this case, the housing can be displaced within the flange, during normal operation both parts being fixed against one another with at least one preferably bolt-shaped overload element, while upon strong impact, the overload element is sheared off by the housing and the housing is pushed backwards by the flange together with the rotatable plate and the drawbar with the spring elements.

The housing may also be provided on the end facing away from the coupling head with a safety component in the form of a plastically deformable tubular piece fastened to the flange, which tubular piece, absorbing energy when there is overload, co-operates with a hub of the housing that penetrates into the tubular piece.

BRIEF DESCRIPTION OF THE DRAWINGS

The invention is explained in detail below by means of exemplary embodiments with reference to the drawings. These show as follows.

DETAILED DESCRIPTION OF THE INVENTION

Figure 1:
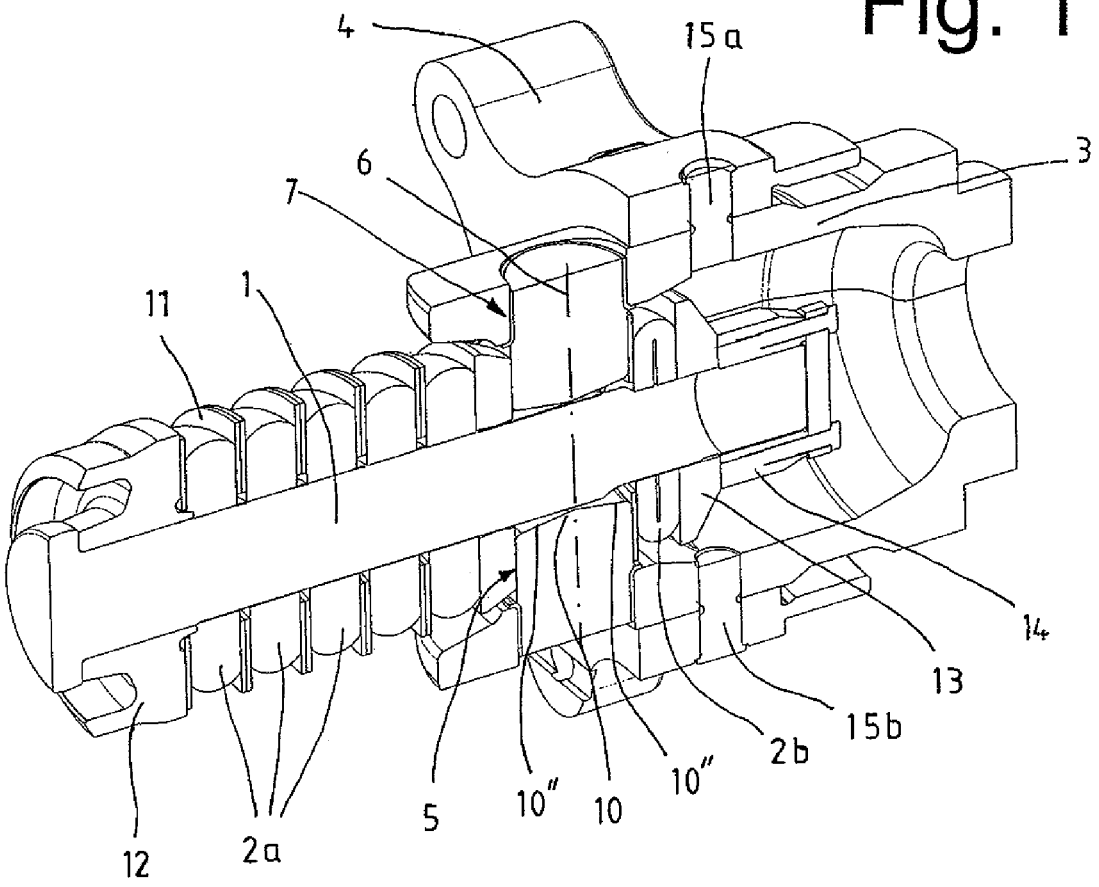
FIG. 1 is a longitudinal section of a linkage device for a coupling of a railway vehicle, the sections being illustrated without shading.

The linkage device shown in FIG. 1 is designed as an independent assembly and it comprises a drawbar 1 with spring elements 2*a*, 2*b* mounted on the drawbar 1 for damping the compressive and tensile forces acting on the coupling, as well as a housing 3 with a flange 4, with which the assembly is fitted onto the railway vehicle or similar.

Figure 2:
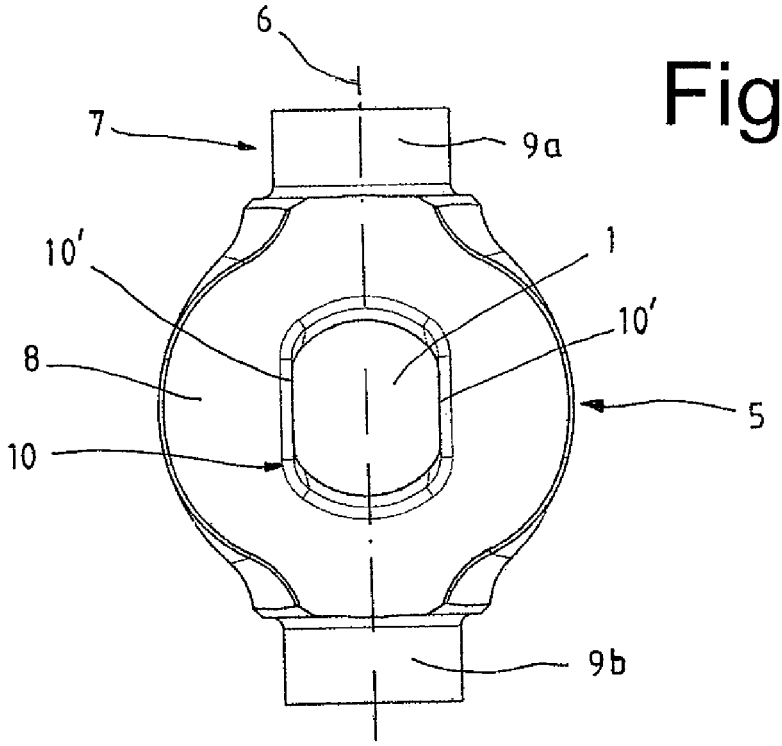
FIG. 2 shows the plate of the linkage device according to FIG. 1 in a front view and the drawbar in cross-section.

According to the invention, the spring elements 2*a*, 2*b* are disposed on both sides of a plate 5 which can be rotated about the axis of rotation 6 of a steering pivot 7 for the drawbar 1. As is evident from FIG. 2, the rotatable plate 5 comprises an annular disc 8 and a steering pivot 7 with two diametrically arranged pivot pins 9*a*, 9*b*, the annular disc 8 being provided with a central through hole 10 through which the drawbar 1 projects, while the pivot pins 9*a*, 9*b* are mounted in bore holes of the housing 3. In order to enable assembly, the housing 3 is formed along the central diametric plane by two half shells.

The through hole 10 and the drawbar 1, as viewed in cross-section, are advantageously provided on both sides with a flattening 10' so that the drawbar 1 is secured non-rotatably therein. In addition, this through hole 10 is formed, at least in the upper and the lower region as viewed in the axial direction, with widenings 10" on both sides passing outwardly from its center. This also enables deflection of the coupling in the vertical plane, the borehole being designed so that the coupling can perform a deflection in the vertical plane of approximately +/−6° upwards and downwards.

The construction is designed for a deflection of the drawbar 1, and so of the coupling head, in the horizontal plane of approximately +/−20° to the right and the left.

The spring elements 2*a* on the side of the rotatable plate 5 facing the coupling head serve to dampen the compressive forces acting on the coupling. They are produced from an elastomeric material, the spring assembly being designed with a maximum pressure stroke of overall approximately 60 mm. The spring element 2*b* on the side of the rotatable plate 5 facing away from the coupling head is likewise produced from an elastomeric material and on its part serves to dampen the tensile forces acting on the coupling. These tensile forces are substantially less than the compressive forces that occur. Accordingly, the spring element 2*b* is designed with a maximum tensile stroke of approximately 10 mm.

The number of spring elements on the front and the rear side of the rotatable plate 5 may be determined as the case arises when coupling anticipated compressive and tensile forces. In the assembly that is formed according to FIG. 1, five spring elements 2*a* are provided between the front bushing and the plate or this one spring element 2*b* is provided between the plate and a rear-side locking disc 13.

When the coupling is deflected, the rotatable plate 5 is also deflected within the limit values specified above. As a result, even when the coupling is deflected, the compressive and tensile forces acting on it act evenly over the entire surface of the spring elements 2*a*, 2*b*. As a result, the damping effect of the spring elements is optimal. For this purpose, it is advantageous if the spring elements are supported laterally by spacer discs 11 made of sheet metal lying in between.

The spring elements 2*a*, 2*b* are incorporated onto the drawbar 1 between a bushing 12 disposed on the front end of the drawbar, to which end the coupling head can be connected, for example by welding, and the locking disc 13 disposed on the rear end of the drawbar. The locking disc serves to fix the spring elements 2*a*, 2*b* and the rotatable plate 5 against the bushing 12 by being pressed against a screw connection 14 that can be screwed in at the rear end of the drawbar.

After the assembly consisting of the housing 3 with the flange 4, the rotatable plate 5 with the steering pivot 7 and the drawbar 1 with the spring elements 2*a*, 2*b* have been fitted on the railway vehicle, the coupling can be welded to the coupling head and the draw and buffing gear to the bushing 12 of the drawbar 1. The design that has been described is advantageous for the assembly of the linkage device as well as for the inspection and adjustability of the individual components.

The linkage device can also be provided with overload protection. In this case, the housing 3 can be axially displaced within the flange 4, in normal operation both parts being fixed against one another with bolt-shaped overload elements 15*a*, 15*b* which are sheared off by the housing 3 when there is overload. In this way, this housing can be pushed backwards by the flange 4 together with the rotatable plate 5 and the drawbar 1 with the spring elements 2*a*, 2*b*. The number of overload elements may vary according to a defined impact force.

Figure 3:
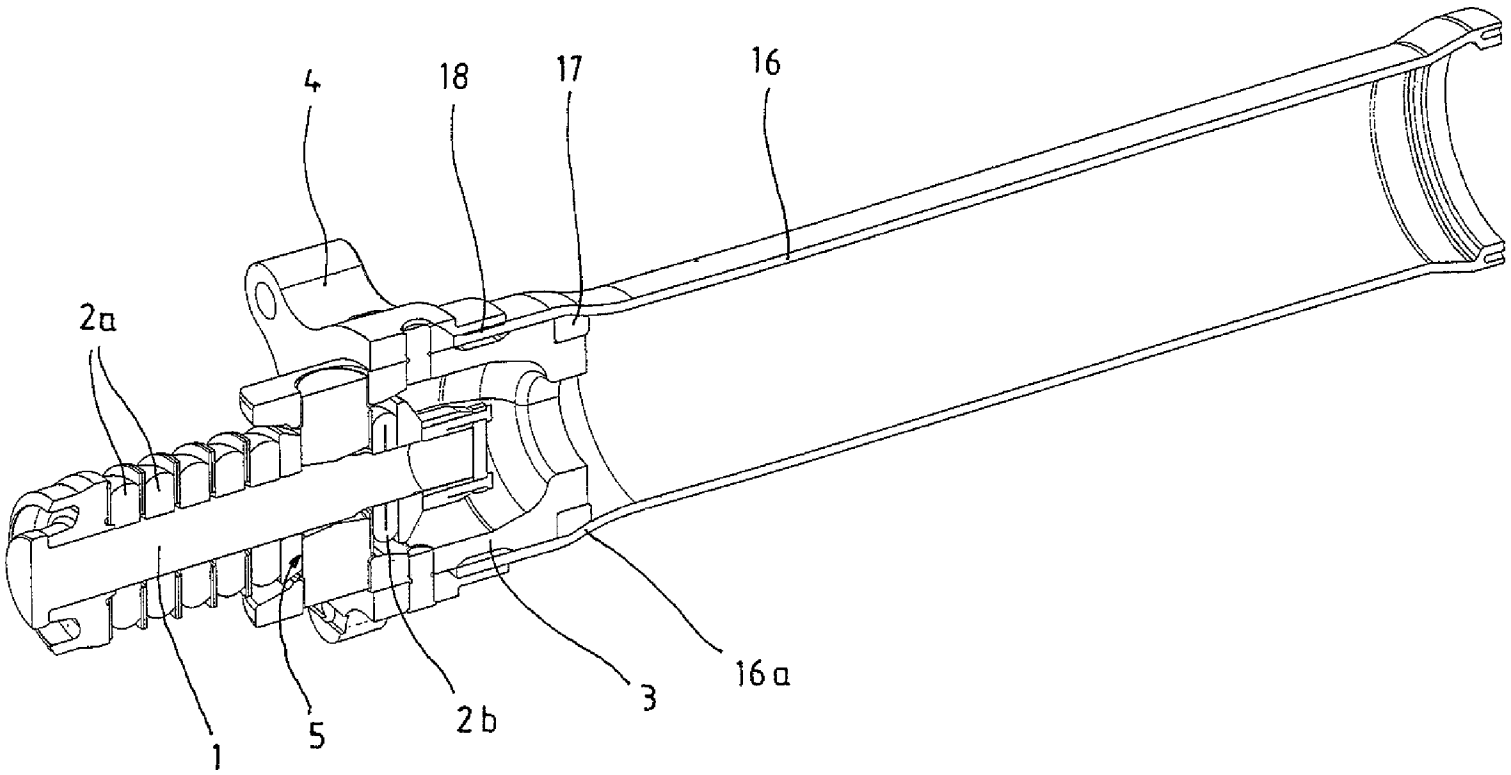
FIG. 3 is a longitudinal section view of a variant of the linkage device according to FIG. 1 with a plastically deformable tubular piece as a safety component.

Within the framework of the invention, the linkage device may also include a safety device which absorbs the impact energy within specific limits upon the impact of another vehicle. This type of device is shown in FIG. 3. The housing 3 additionally has on the end facing away from the coupling head a safety component fastened to the flange 4, which safety component is in the form of a plastically deformable tubular piece 16 which co-operates in an energy absorbing manner with a hub 17 of the housing 3 penetrating into the tubular piece 16 when there is overload.

The tube end of the tubular piece 16 provided with a diameter widening 16*a* projects into an annular gap 18 between the flange 4 and the housing 3 and is fastened here to the flange 4 with a releaseable connection, such as preferably a screw or bayonet connection.

The housing 3 and the flange 4 could also be made from one part if no additional overload elements are provided. The rotatable plate 5 could consist of the annular disc 8 and the pivot pins 9*a*, 9*b* which can, for example, be screwed into the latter so that the drawbar with the spring elements and the annular disc could be pushed into the housing, and then the pivot pins could be screwed into the annular disc from the outside.

The through hole 10 in the plate 5 could also be made to be almost cylindrical without any lateral flattenings 10'. In addition, it could likewise be provided on both sides with widenings in the lateral regions, as viewed in the axial region, passing outwards from its center.

The invention claimed is:

1. A linkage device for a vehicle coupling, the linkage device comprising:

a housing having a rotatable plate;

a drawbar connectable to a coupling head and mounted in the plate of the housing;

a first spring element mounted on the drawbar and configured to dampen a compressive force of a vehicle that arises during coupling;

a second spring element mounted on the drawbar and configured to dampen a tensile force of the vehicle that arises during coupling;

a flange with a housing connectable to the vehicle, wherein the plate in the housing is disposed between the first spring element and the second spring element; and a plastically deformable tubular body that extends from a gap between the housing and the flange to outside of the housing and the flange, wherein the tubular body is configured to absorb energy when there is overload and cooperates with a hub of the housing that penetrates into the tubular body.

2. The linkage device of claim 1, wherein the plate is rotatable about an axis of rotation and comprises an annular disc and a steering pivot including diametrically arranged pivot pins.

3. The linkage device of claim 2, wherein the annular disc includes a through hole for the drawbar between the first spring element and the second spring element.

4. The linkage device of claim 3, wherein the through hole of the annular disc of the plate is formed on both sides with widenings in an upper and a lower region along an axial direction oriented outward from a center of the annular disc.

5. The linkage device of claim 1, wherein the first spring element is arranged on a side of the plate that faces the coupling head to dampen the compressive force.

6. The linkage device of claim 1, wherein a number of the first and second spring elements is based on anticipated magnitudes of the compressive and tensile forces.

7. The linkage device of claim 1, wherein at least one of the first spring element or the second spring element includes an annular disc formed from an elastomeric material.

8. The linkage device of claim 7, wherein the annular disc is laterally supported against spacer discs.

9. The linkage device of claim 1, wherein the first and second spring elements are on the drawbar between a bushing for the coupling head on a front end of the drawbar and a locking disc disposed on a rear end of the drawbar to fix the first and second spring elements against the plate.

10. The linkage device of claim 9, wherein the locking disc is pressable against the second spring element with a connection disposed on the rear end of the drawbar.

11. The linkage device of claim 1, further comprising the plate having a steering pivot mounted in a sleeve-shaped housing with a flange that is configured to fasten to the vehicle.

12. The linkage device of claim 11, wherein the sleeve-shaped housing is axially moveable within the flange.

13. The linkage device of claim 12, wherein the sleeve-shaped housing and the flange are fixed against each other with an overload element configured to be sheared off by the sleeve-shaped housing that is pushed by the flange together with the plate and the drawbar with the spring elements.

14. A linkage device for a vehicle coupling, the linkage device comprising:

a housing having a rotatable plate;

a drawbar connectable to a coupling head and mounted in the plate of the housing;

a first spring element mounted on the drawbar and configured to dampen a compressive force of a vehicle that arises during coupling;

a second spring element mounted on the drawbar and configured to dampen a tensile force of the vehicle that arises during coupling;

a flange with a housing connectable to the vehicle, wherein the plate in the housing is disposed between the first spring element and the second spring element, wherein the drawbar includes a first flattening and the plate includes an annular disc having a through hole with a second flattening that faces the first flattening of the drawbar.

15. The linkage device of claim 14, wherein the plate is rotatable about an axis of rotation and comprises a steering pivot including diametrically arranged pivot pins.

16. The linkage device of claim 14, wherein the through hole of the annular disc of the plate is formed on both sides with widenings in an upper and a lower region along an axial direction oriented outward from a center of the annular disc.

17. The linkage device of claim 14, wherein the first spring element is arranged on a side of the plate.

18. The linkage device of claim 14, wherein a number of the first and second spring elements is based on anticipated magnitudes of the compressive and tensile forces.

19. The linkage device of claim 14, wherein the annular disc is formed from an elastomeric material.

20. The linkage device of claim 14, wherein the annular disc is laterally supported against spacer discs.

* * * * *